United States Patent [19]

Dornau et al.

[11] 4,228,758

[45] Oct. 21, 1980

[54] LABELLED BOTTLE-BOAT FENDER

[76] Inventors: Peter G. Dornau, 9290 SW. 117th Ter., Miami, Fla. 33156; Arthur Spector, 254 Seaview Dr., Key Biscayne, Fla. 33149

[21] Appl. No.: 23,124

[22] Filed: Mar. 23, 1979

[51] Int. Cl.[3] ..... B63B 59/02

[52] U.S. Cl. ..... 114/219; 215/365; 215/1 C; 215/100 R; 206/45.34

[58] Field of Search ..... 215/1 C, 1 R, 100 R, 215/365; 114/219, 267; 9/8 R; 220/82 A; 206/459, 45.31–45.34

[56] References Cited

U.S. PATENT DOCUMENTS

| | | | |
|---|---|---|---|
| 3,145,686 | 8/1964 | Blythe | 114/219 |
| 3,183,875 | 5/1965 | Russell | 114/219 |
| 3,235,112 | 2/1966 | Fillwalk | 215/365 |
| 3,332,563 | 7/1967 | Reshan | 215/365 |
| 3,386,200 | 6/1968 | Beretta | 215/100 R |
| 3,443,710 | 5/1969 | Hills | 215/1 C |
| 3,803,332 | 4/1974 | Seiferth | 206/45.34 |

*Primary Examiner*—Edward R. Kazenske
*Assistant Examiner*—D. W. Keen
*Attorney, Agent, or Firm*—Caesar, Rivise, Bernstein & Cohen, Ltd.

[57] ABSTRACT

A merchandising container in the form of a labelled bottle and suitable for use as a boat fender. The bottle comprises a hollow body for holding a flowable material therein. The body includes a top wall portion having an opening communicating with the interior of the body, a threaded cap covering the opening, a bottom wall portion and a side wall portion disposed between the top wall portion and the bottom wall portion. The side wall forms the periphery of the body and includes two pairs of planar opposed wall portions. Each of the wall portions of one pair include a pair of tapered depressions therein which are aligned with an identical pair of tapered depressions in the opposed wall portion. Each depression includes an upper and lower conically shaped surface and a pair of planar surfaces extending between the corresponding ends of the conically shaped surfaces. The bottom of the aligned opposed depressions forms a common wall therebetween which includes an aperture of sufficient size to accommodate nautical rope therethrough. One aperture is located below the top wall and the other aperture is located above the bottom wall. A removable label encircles the side wall and over the depressions. The label includes a transparent window exposing a depression to view while the label is on the bottle.

2 Claims, 5 Drawing Figures

LABELLED BOTTLE-BOAT FENDER

This invention relates generally to bottles and, more particularly, to merchandising bottles which serve as a premium by virtue of enabling use as a viable boat fender.

Most liquids sold today are packaged in either cans, jars or bottles. After the contents of such containers are used up the containers are normally discarded as refuse. In the interest of ecology, some containers, e.g., glass bottles, aluminum cans, etc., are recycled, but such action is not widespread. In the interest of ecology some enterprising persons have saved containers making use of them for various purposes unrelated to storage. For example, jug-type containers, like plastic milk jugs, have been used as boat bumpers or fenders by looping nautical line through the handle and hanging the jug over the gunwale of the boat. Such an arrangement, while laudable from an ecology standpoint, leaves much to be desired from the standpoint of effectiveness in protecting the boat. The limited effectiveness of the use of a plastic jug as a boat fender is due to the fact that the shape of the jug, e.g., the large aperture handle, causes the jug to hang below the boat's gunwale and not immediately opposite thereto, which position is necessary to prevent impact damage from an adjacent boat or static structure.

In the U.S. Pat. No. 3,145,686 (Blythe) there is disclosed a boat bumper which may also serve as a storage container in order to save valuable space on a boat. The bumper comprises a hollow, right circular cylinder body portion having an opposed pair of flat end walls. A hollow, threaded nipple projects outward from one sidewall and communicates with the interior of the body portion to serve as a mouth for pouring material into or out of the body portion. A threaded cap is screwed into engagement on the nipple. A thin, planar flange projects outward normally from each end wall. Each flange includes an opening therein adjacent its free end and arranged to receive a rope or other suitable line to hang the bumper from the boat.

The provision of the projecting flanges in the Blythe patent renders the container unsuitable for merchandising applications since their location preclude vertical disposition or storage of the container on one of its end walls. Moreover, the openings in the flanges are located well beyond the cylindrical body portion of the bumper so that when the bumper is hung on the boat the thin flange is located opposite the gunwale while the body portion hangs substantially therebelow. This disposition renders the boat susceptible to damage by impact from another at the gunwale.

While some bumpers or boat fenders have been disclosed in the patent literature, e.g., U.S. Pat. Nos. 3,183,875 (Russell), 3,498,252 (Peacock) and 3,861,345 (Hull) and appear suitable for their intended purposes, such bumpers are not suitable as bottles for merchandising or storage applications.

In U.S. Patent application Ser. No. 010,119, filed on Feb. 7, 1979 there is disclosed a container-boat fender which is suitable for merchandising flowable materials, and which, when emptied of its contents, can be utilized to form a boat fender. The container-boat fender disclosed in the application basically comprises a hollow body having a top wall, a bottom wall and a sidewall. The sidewall defines the periphery of the body and includes two pairs of opposed planar wall portions.

Each planar wall portion includes a pair of conical depressions therein. Each depression tapers downward in cross-section towards its bottom. One depression in one wall portion is aligned with an identically constructed depression in the opposed wall. The bottom of the aligned opposed depressions form a common wall including an aperture of sufficient size to accommodate a section of nautical rope therethrough. One depression and the aligned depression in the opposed sidewall portion is located immediately below the top wall of the container while the other depression in the said sidewall portion, and its aligned depression in the opposed sidewall portion, is located above the bottom wall of the bottle.

The top wall of the bottle includes a threaded mouth on which a cap is releasably secured. The bottle is arranged for holding flowable materials, e.g., liquids and powders, therein for the merchandising and storage of such materials. When the materials have been used up the bottle is suitable for use as a boat fender by looping a piece of nautical rope through the opening in a pair of aligned depressions.

By virtue of the fact that the aligned depressions lie above and below the top and bottom walls of the bottle when the bottle is hung from the gunwale of the boat by threading the nautical line through the aligned depressions, the sidewall of the bottle is disposed immediately adjacent to the boat gunwale. This action ensures that the body of the bottle is available for impact by another boat or structure.

While the container-boat fender of the aforenoted patent application is suitable for its intended purposes, its use of conically shaped depressions results in a construction that is relatively difficult to fabricate by conventional blow-molding techniques. Moreover, the relatively large area taken up by the conical depressions may impede the flow of material out of the bottle and, in addition, render the bottle susceptible to rupture or collapsing from a heavy, sharp impact at the corner where the wall portion including the depressions meets the contiguous wall portion.

Accordingly, it is a general object of the instant invention to provide a merchandising bottle which is suitable for use as a boat fender and which is an improvement over the prior art devices, including the container of the aforenoted United States patent application.

It is a further object of this invention to provide a bottle which is suitable for use as a viable boat fender and which can be readily formed of plastic using conventional forming techniques.

It is still a further object of the instant invention to provide a bottle which can be used as a boat fender and which exhibits improved impact absorption.

It is still a further object of this invention to provide a bottle having a label thereon so as to exhibit a conventional appearance and which is suitable, when the label is removed, for forming a viable boat fender.

It is yet a further object of this invention to provide on a bottle forming a boat fender an encircling label including a window enabling one to see the fender producing portion of the bottle to act as a merchandising attraction.

These and other objects of the instant invention are achieved by providing a bottle-boat fender. The bottle-boat fender comprises a hollow body for holding a flowable material therein and includes a top wall portion, having an opening communicating with the interior of said body, closure means releasably secured to the opening, a bottom wall portion and a sidewall disposed between the top wall and bottom wall and forming the periphery of the body. The sidewall includes a pair of opposed wall portions. Each of the opposed wall portion includes at least one tapered depression. Each depression includes an upper and lower conically-shaped surface and a pair of planar surfaces extending between corresponding ends of the conical surfaces. The depression tapers downward in cross-section toward its bottom. The depression in one wall portion is aligned with a similarly constructed depression in the opposed wall portion. The bottom of the aligned opposed depressions form a common wall having an aperture of sufficient size to accommodate a section of nautical rope therethrough. The aligned depressions are located below the top wall and above the bottom wall. A removeable label is disposed over said depressions to give the bottle-boat fender a conventional bottle-like appearance.

In a preferred aspect of the invention, the label encircles the sidewall of the bottle-fender and includes a transparent window for exposing to you one of the depressions.

Other objects and many of the attendant advantages of this invention will be readily appreciated as the same becomes better understood by reference to the following detailed description when considered in connection with the accompanying drawings, wherein.

Figure 1:
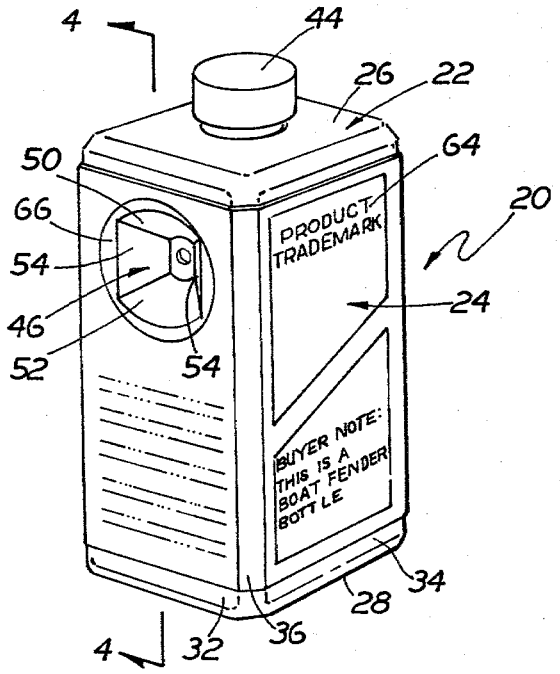
FIG. 1 is a perspective view of the labelled bottle-boat fender of the instant invention.

Referring now to the various figures of the drawing wherein like reference characters refer to like parts, there is shown generally at 20 in FIG. 1 a bottle-boat fender of the instant invention. The article 20, as will be described in detail later, is a hollow member suitable for holding flowable materials, e.g., liquids, powders, etc., and includes a removable label to give the article a conventional bottle-like appearance. When emptied of its contents the article is suitable for use as a boat fender or bumper, preferably by placing some ballast, e.g., water, in the article. The label can be removed when the article is used as a fender to provide an aesthetically pleasing, yet functional appearance. Moreover, when the article is not being used as a boat fender or bumper, it is also suitable for use for storing materials, e.g., oil, etc., which are normally stored in other containers on a boat, thereby saving valuable space on the boat.

The article 20 is in the form of a hollow body porton 22 having a merchandising label 24 thereon. As will be described in detail later, the label is arranged to be readily removed from the article's body after its merchandising function is no longer necessary. The body 22 includes a top wall 26, a bottom wall 28 and an encircling sidewall 30. The sidewall defines the periphery of the body and basically comprises two pairs of opposed planar wall portions 32 and 34. Each planar portion 32 extends normally to each planar portion 34. The inner face of the immediately adjacent planar wall portion 32 and 34 is in the form of a narrow, angularly extending corner 36.

Figure 4:
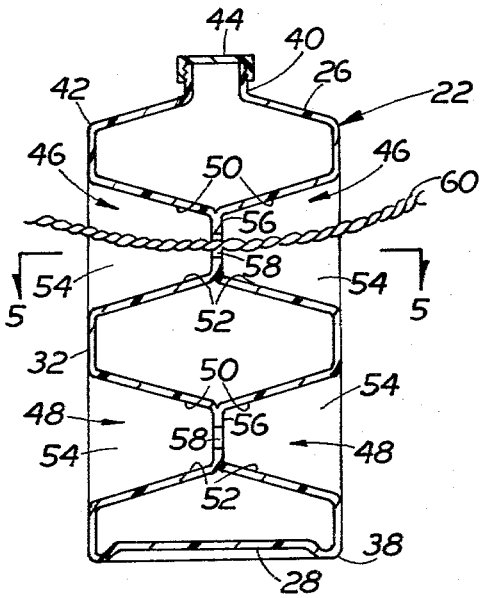
FIG. 4 is a sectional view taken along line 4—4 of FIG. 1.

As can be seen in FIG. 4, the bottom wall 28 is slightly depressed at the central portion thereof to form a peripheral lip 38 at the interface of the bottom wall 28 and the encircling sidewall 30. The peripherally extending lip 38 serves as the base upon which the article 20 is disposed when storing materials therein.

The top wall 26 includes a hollow externally threaded mouth 40 at the center thereof. The mouth communicates with the hollow interior of the body 22. The top wall 26 extends slightly downward from the base of the mouth to the interface 42 where the top wall 26 joins the side wall 30. A threaded cap 44 is arranged to be screwed on the mouth 40 to close the mouth and seal the contents in the bottle.

The interior of the body serves as a convenient storage space for liquids, powders or other flowable particulate materials. Accordingly, the article 20 serves as a viable container for merchandising various liquid or particulate material products. The label 24 facilitates the merchandising of the article 20 and it contents by carrying advertising or other promotional indicia thereon. Once the article is emptied of its contents, it is suitable for service as a viable boat fender or bumper to hang from the boat's gunwale to protect the boat from damage caused by impact with other boats or stationary structures.

Figure 2:
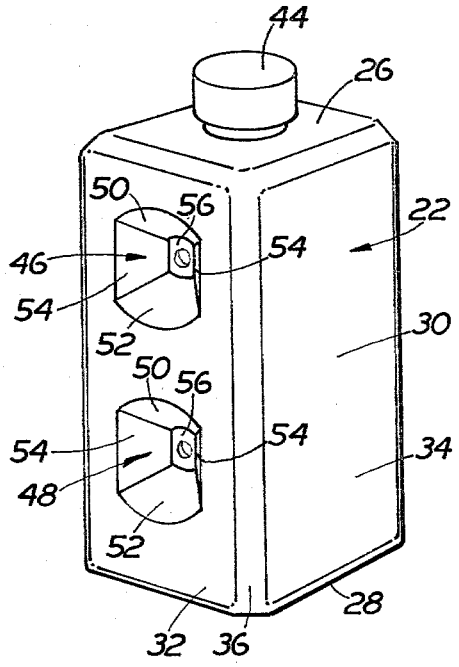
FIG. 2 is a perspective view, like that of FIG. 1, but showing the bottle-boat fender with its label removed.
Figure 5:
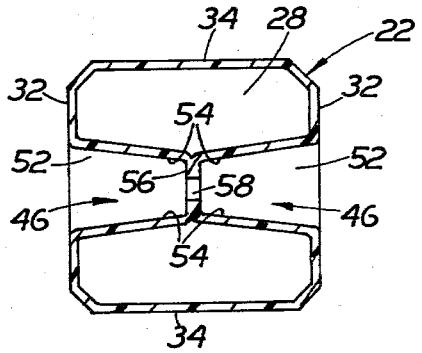
FIG. 5 is a sectional view taken along line 5—5 of FIG. 4.

As shown in FIGS. 2 and 4 each of the opposed planar wall portions 32 includes a pair of depressions 46 and 48. As shown clearly in the views of FIGS. 2, 4 and 5 each of the depressions 46 and 48 tapers downward in cross-section towards its bottom and includes upper and lower conically shaped surface sections 50 and 52, respectively, and a pair of planar surfaces 54 extending between corresponding ends of the conical sections.

The bottom of each depression 46 and 48 is identified by the reference numeral 56. As can be seen clearly in FIGS. 2, 4 and 5 the upper depression 46 in one sidewall portion 32 is aligned with an identical depression 46 in the opposed sidewall 32, with the bottom portion 56 of the aligned depressions forming a common wall therebetween. A central opening 58 is located in the common wall 56. The opening 58 is provided to receive a boat rope or line therethrough to hang the article on the boat. To that end the diameter of the opening 58 is just larger than the diameter of a typical boat rope or line. The lower depression 48 in one sidewall 32 is aligned with an identical depression 48 in the opposed sidewall 32, with the bottom 56 of each depression forming a common wall therebetween, also including an opening 58 which is adapted to receive a boat rope or line therethrough.

The upper depressions 46 are located so that their central opening 58 lies substantially below the top edge 42 of the body, while the bottom depressions 48, and their central opening 58, lie substantially above the bottom rim 38. This feature ensures that the article is disposed immediately opposite the gunwale of a boat and not therebelow when it is hung from either opening 58. In this regard, as will be appreciated by those skilled in the art, if a fender or bumper is not disposed opposite the gunwale, but is, in fact, disposed therebelow the boat is susceptible to impact at its gunwale from another boat or from a stationary structure, such as a pier.

Figure 3:
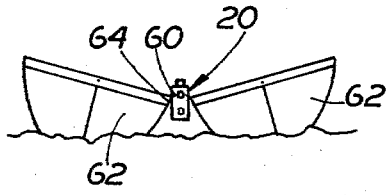
FIG. 3 is a schematic view of the bottle-boat fender of the instant invention shown in operative position hung on the gunwale of a boat.

Use of the article 20 as a bumper or fender is as follows: A rope or other nautical line 60 (FIG. 4) is extended through the central opening 58 in the aligned upper depressions 46. The rope is then knotted to secure the article 20 thereon. Water or other ballast is then placed in the hollow interior of the article to give it sufficient mass to prevent its flopping about due to boat motion or wind. The cap 44 is then placed on the article's mouth and the article is then ready to be hung along the gunwale of a boat. To that end as shown in FIG. 3, the rope 60 is lashed and tied about a suitable cleat (not shown) or other support on the boat 62 so that one of the article's flat sidewalls 32 abuts the boat's gunwale. Since the opening 58 through which the rope 60 is extended is located below the top edge 42 of the article 20, when the article is secured in place, it remains located opposite the gunwale. This action ensures that the body of the article is available for impact by another boat 62 or other structure (not shown).

As will be appreciated by those skilled in the art, the aligned depressions 46 and the aligned depressions 48, in addition to establishing openings for hanging the article, also strengthen the body of the article in a manner akin to the reinforcement produced by the walls of a honeycomb. Accordingly, the article of the instant invention can sustain considerable impact without collapsing even though the thickness of the material making up the sidewalls is relatively thin, e.g., 1/16th of an inch (1.6 mm).

In accordance with a preferred aspect of this invention, the body of the article 20 is formed by blowmolding it as an integral unit of a strong, yet lightweight material, such as plastic.

As will be appreciated by those skilled in the art, the use of the planar portions in the depressions facilitates the molding of the article 20. In addition, the spacing of the planar wall portions of each depression from the corner 36 of the body reduces stress concentrations which could cause the body to rupture when filled with ballast, such as water, if the article 20 is not lying perfectly flat with its side 32 along the boat's gunwale. Moreover, the spacing provided between the planar portions 54 of the article's depressions and the adjacent sidewalls 34 enables the body 22 to be filled and emptied readily without impediment.

As can be seen clearly in FIG. 1 the label 24 comprises a band of material, such as a heat-shrunk plastic, and includes various indicia 64 printed thereon. The indicia may comprise the product's trademark, instructions for use, contents, etc.

In accordance with a preferred aspect of the invention, the label is not permanently secured to the surface of the body but rather releasably secured thereto so that the label can be removed therefrom when its use is no longer needed. The removal of the label renders the article 20 aesthetically pleasing.

In accordance with another preferred aspect of this invention, the label 24 includes a window 66 therein which, when the label is disposed on the bottle, exposes one of the depressions, e.g., 46, to view. This feature is of considerable importance from a commercial standpoint since it enables the buyer to appreciate the use the article can be put to as a boat fender once its contents are used. This obviously has great commercial appeal. The window 66 can be formed in various conventional ways, such as in the form of an opening, a transparent panel, etc. In the preferred embodiment shown, the window 66 merely comprises a transparent portion of the label 24.

As will thus be appreciated from the foregoing, the article of the instant invention has considerable appeal as a merchandising premium since it can be used as a container for selling liquids, powders, or other flowable materials, and can carry advertising or other promotional indicia in the form of a removable label. Therefore, once the purchaser uses up the material and removes the label, the article can be used as an effective boat fender by merely threading a rope through either of the aligned openings therein. Moreover, when the article 20 is not actually used as a fender on the boat, it can store materials therein which would otherwise be stored in other containers of the boat, thereby saving valuable boat space.

Without further elaboration, the foregoing will so fully illustrate our invention that others may, be applying current or future knowledge, readily adapt the same for use under various conditions of service.

What is claimed as the invention is:

1. A bottle-boat fender formed of plastic and comprising a hollow body for holding a flowable material therein and including a top wall portion, having an opening communicating with the interior of the body, closure means releasably secured to the opening, a bottom wall portion and a sidewall disposed between the top wall and bottom wall and forming the periphery of the body, said sidewall being relatively thin and including a first pair of opposed wall portions, and a second pair of opposed wall portions, each of the wall portions of said first and second pairs merging together at respective corners, each of the opposed wall portions of said first pair including at least one tapered depression therein, each depression including an upper and a lower conically shaped surface and a pair of planar surfaces extending between corresponding ends of said conical surfaces, said planar surfaces being spaced from said corners to reduce stress concentrations thereat, each of said depressions tapering downward in cross-section towards its bottom, with the depression in one wall portion being aligned with a similarly constructed depression in the opposed wall portion, the bottom of the opposed aligned depressions forming a common wall having an aperture therein of sufficient size to accommodate a section of nautical rope therethrough, said aligned depressions being located below the top wall and above the bottom wall of said body, and removable label means in the form of a heat-shrunk plastic band frictionally engaged on the periphery of said sidewall and disposed over said depressions to give the bottle-boat fender a conventional merchandising bottle-like appearance, said label comprising an opaque portion bearing printed indicia and a transparent panel window portion located only over said first pair of opposed wall portions for exposing to view at least one of said depressions.

2. The bottle-boat fender of claim 1 wherein said body includes two other aligned depressions constructed similarly to said first mentioned aligned depressions and being located within the same wall portions as said first mentioned depressions.

* * * * *